US009382735B2

(12) United States Patent
Rosales et al.

(10) Patent No.: US 9,382,735 B2
(45) Date of Patent: Jul. 5, 2016

(54) MOTOR VEHICLE LOCK

(71) Applicant: Brose Schliesssysteme GmbH & Co. KG, Wuppertal, Wuppertal (DE)

(72) Inventors: David Rosales, Rochester Hills, MI (US); Michael Wittelsbuerger, Lake Orion, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 240 days.

(21) Appl. No.: 14/030,831

(22) Filed: Sep. 18, 2013

(65) Prior Publication Data

US 2015/0076833 A1 Mar. 19, 2015

(51) Int. Cl.

| | |
|---|---|
| ***E05B 65/10*** | (2006.01) |
| ***E05B 85/26*** | (2014.01) |
| ***E05B 77/38*** | (2014.01) |
| ***E05B 77/42*** | (2014.01) |
| ***E05B 81/20*** | (2014.01) |
| *E05B 77/02* | (2014.01) |

(52) U.S. Cl.

CPC ..... *E05B 85/26* (2013.01); *E05B 77/38* (2013.01); *E05B 77/42* (2013.01); *E05B 81/20* (2013.01); *E05B 77/02* (2013.01); *Y10T 292/0908* (2015.04); *Y10T 292/1052* (2015.04); *Y10T 292/1078* (2015.04)

(58) Field of Classification Search

CPC ..... Y10T 292/688; Y10T 292/0908; E05B 77/38; E05B 77/40; E05B 17/0045; E05B 77/36; E05B 15/022; E05B 15/04; E05B 17/0037; E05B 81/22; E05B 2015/0448; E05B 77/02; E05B 77/42; Y10S 292/56

USPC ..... 292/93, 219–220, 229, DIG. 73, 292/DIG. 61, DIG. 56

See application file for complete search history.

(56) References Cited

U.S. PATENT DOCUMENTS

| | | | | |
|---|---|---|---|---|
| 8,608,245 | B2 * | 12/2013 | Wieclawski | 297/378.13 |
| 8,950,810 | B2 * | 2/2015 | Dryburgh et al. | 297/336 |
| 9,050,911 | B2 * | 6/2015 | Wieclawski et al. | |
| 2012/0049543 | A1 * | 3/2012 | Park | 292/220 |

FOREIGN PATENT DOCUMENTS

| | | |
|---|---|---|
| DE | 3825594 | 2/1990 |
| DE | 19652012 | 6/1998 |
| DE | 102010061518 | 4/2012 |
| EP | 1867808 | 5/2009 |
| FR | 2488935 | 2/1982 |
| FR | 2897380 | 5/2012 |

OTHER PUBLICATIONS

Extended European Search Report for European Patent Application No. 14175462.0, mailed Jul. 3, 2015 (3 pages).

* cited by examiner

*Primary Examiner* — Mark Williams

(74) *Attorney, Agent, or Firm* — Pauly, Devries, Smith & Deffner, LLC

(57) ABSTRACT

The invention is directed to a motor vehicle lock for a motor vehicle door arrangement, wherein a pivotable catch and an inlet mouth for a lock striker are provided, wherein the catch can be brought into at least one closed position and into at least one open position, wherein the catch as such in its closed position may hold the lock striker by a holding engagement between the catch and the lock striker and in its open position may release the lock striker, wherein during a closing cycle the lock striker comes into an actuating engagement with the motor vehicle lock such that the catch moves from its open position into its closed position.

18 Claims, 4 Drawing Sheets a)

b)

MOTOR VEHICLE LOCK

FIELD OF THE INVENTION

The invention is directed to a motor vehicle lock.

BACKGROUND

The motor vehicle lock in question is assigned to a motor vehicle door arrangement which comprises at least a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

The acoustic characteristic of the motor vehicle lock in question is of importance today, as such acoustic characteristic may considerably decrease the operating comfort. Subject of the present discussion is the acoustic characteristic during the closing cycle of the motor vehicle lock.

The known motor vehicle lock (EP 1 867 808 B1) comprises a pivotable catch and a pivotable pawl assigned thereto. The motor vehicle lock further comprises an inlet mouth for a lock striker. Usually the motor vehicle lock is arranged at a door of the motor vehicle door arrangement, while the lock striker is arranged at the body of the motor vehicle. The catch can be brought into a main closed position and into a preliminary closed position, in which the catch may hold the lock striker by a holding engagement between the catch and the lock striker. In its open position the catch releases the lock striker.

During a closing cycle, which is initiated by a closing movement of the door of the motor vehicle door arrangement, the striker comes into an actuating engagement with the catch such that the catch moves from its open position into its respective closed position.

The known motor vehicle lock has proved to be reliable and easy to manufacture. However, the actuating engagement between the lock striker and the catch requires constructional measures for reducing the resulting impact noise. Such measures are, for example, the coating of the catch by a damping material.

It is the object of the invention to improve the known motor vehicle lock such that the acoustic characteristic during a closing cycle of the motor vehicle lock is improved.

SUMMARY OF THE INVENTION

The present invention provides an actuating element that, during a closing cycle of the motor vehicle lock, interacts with the lock striker instead of the catch itself. It has been discovered that with a proper coupling between the actuating element and the catch it is possible to considerably decrease the impact noise during the closing cycle of the motor vehicle lock. In particular, a coating of the catch with damping material is not necessary, as far as the closing cycle is concerned.

In an embodiment, a motor vehicle lock for a motor vehicle door arrangement has a pivotable catch and an inlet mouth for a lock striker, wherein the catch can be brought into at least one closed position and into at least one open position, wherein the catch as such in its closed position may hold the lock striker by a holding engagement between the catch and the lock striker and in its open position may release the lock striker, wherein during a closing cycle the lock striker comes into an actuating engagement with the motor vehicle lock such that the catch moves from its open position into the direction of its closed position, preferably into its closed position, wherein an actuating element is provided, which is displaceable relative to the catch and which is coupled to the catch such that during the closing cycle the actuating engagement of the lock striker with the actuating element causes the catch to move from its open position into the direction of its closed position, preferably into its closed position, for establishing the holding engagement between the catch and the lock striker.

In further detail an actuating element is provided, which is at least slightly displaceable relative to the catch itself and which is coupled to the catch such that during the closing cycle the actuating engagement of the lock striker with the actuating element causes the catch to move from its open position into the direction of its closed position, preferably into the closed position, for establishing the holding engagement between the catch and the lock striker.

With the proposed solution it is possible to have the lock striker engage the actuating element before the lock striker engages the catch. As the first engagement between the lock striker and the actuating element may easily be laid out for noise reduction the resulting overall acoustic characteristic may be optimized considerably.

It has further been found that with the proposed actuating element it is possible to reduce the necessary pivot angle range of the catch significantly, which increases the freedom in construction. For example it is possible to provide the catch with a basically hook shaped design, which allows a high degree of mechanical stability with comparably little material usage. Also the small pivot angle range leads to a simplification of a spring bias for the catch which spring bias will be explained later.

Depending on the application the catch may be provided with a pivotable pawl. This has proven to be a reliable and simple way to block the catch in its closed position.

An example embodiment which is optimized in view of an improved crash safety that is achieved with low additional constructional effort. In a further embodiment it is proposed that the pawl itself provides part of a crash support arrangement.

Additional embodiments are directed to various possibilities for spring bias of the catch by spring arrangements. In an example embodiment the actuating element is part of or coupled to at least one spring arrangement such that the actuating engagement between the lock striker and the actuating element causes the catch to move into its closed position, driven by spring bias.

The invention is also directed to a motor vehicle lock for a motor vehicle door arrangement, wherein a pivotable catch and an inlet mouth for a lock striker are provided, wherein the catch can be brought into at least one closed position and into at least one open position, wherein the catch as such in its closed position may hold the lock striker by a holding engagement between the catch and the lock striker and in its open position may release the lock striker, wherein during a closing cycle the lock striker comes into an actuating engagement with the motor vehicle lock such that the catch moves from its open position into its closed position. It is proposed that an actuating element is provided, which is at least slightly displaceable relative to the catch and which is coupled to the catch such that during the closing cycle the actuating engagement of the lock striker with the actuating element causes the catch to move from its open position into its closed position for establishing the holding engagement between the catch and the lock striker.

DETAILED DESCRIPTION

Figure 1:
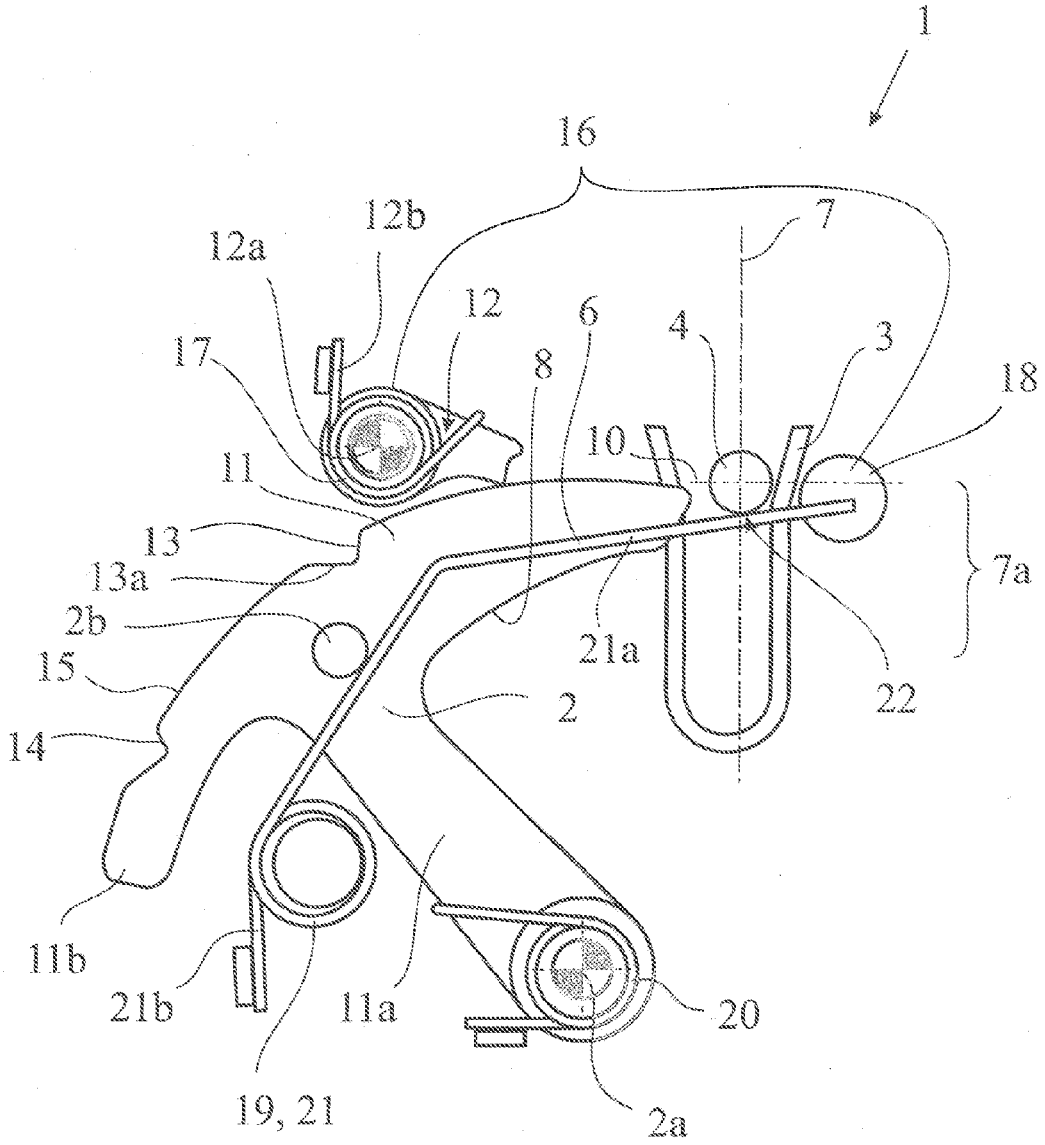
FIG. 1 the components of a proposed motor vehicle lock as far as essential for the invention in the beginning of a closing cycle, FIG. 2 the motor vehicle lock according to FIG. 1 a) during the closing cycle when reaching the preliminary closed position of the catch and b) during the closing cycle when reaching the main closed position of the catch, FIG. 3 the components of a proposed motor vehicle lock according a second embodiment as far as essential for the invention in the beginning of a closing cycle and FIG. 4 the motor vehicle lock according to FIG. 3 a) during the closing cycle when reaching the preliminary closed position of the catch and b) during the closing cycle when reaching the main closed position of the catch.

The motor vehicle lock 1 shown in the drawings is assigned to a motor vehicle door arrangement, which comprises a motor vehicle door. Regarding the broad interpretation of the expression "motor vehicle door" reference is made to the introductory part of the specification. Here the motor vehicle door is a side door of a motor vehicle.

The sequences of FIGS. 1, 2*a*, 2*b*, 3, 4*a*, 4*b* each show the same lock states for the two displayed embodiments. Insofar any general explanation given for one embodiment is fully applicable for the other embodiment. Accordingly all parts with comparable function are denominated by the same reference numbers.

The motor vehicle lock 1 comprises a catch 2, which is pivotable around a catch axis 2*a*. The motor vehicle lock 1 further comprises an inlet mouth 3 for a lock striker 4. The inlet mouth 3 may be constructed as a channel as shown in the drawings. Generally the inlet mouth 3 may as well just be a free area that allows the lock striker 4 to come into engagement with the catch 2 as will be described.

Usually the motor vehicle lock 1 in its installed state is arranged at the motor vehicle door, while the lock striker 4 is arranged at the body of the motor vehicle. Depending on the application this overall structure may be vice versa as well.

Accordingly, a movement of the lock striker 4 relative to the motor vehicle lock 1 here and preferably goes back on the movement of the door of the motor vehicle door arrangement.

The catch 2 can be brought into a preliminary closed position (FIG. 2*a*), into a main closed position (FIG. 2*b*) and into an open position (FIG. 1). The catch 2 as such in its closed positions (FIG. 2*a*, 2*b*) may hold the lock striker 4 by a holding engagement between the catch 2 and the lock striker 4. The direction of the holding forces acting from the lock striker 4 onto the catch 2 are indicated with reference number 5 in the drawings.

The expression "catch 2 as such" means here that the lock striker 4 is being held by the catch 2 alone. Accordingly, no additional catch 2 is provided to hold the lock striker 4. With this arrangement the resulting construction is simple and cost effective.

In its open position the catch 2 releases the lock striker 4 as shown in FIG. 1 such that the door of the motor vehicle door arrangement may be opened.

The closing cycle of the motor vehicle lock is initiated by closing the motor vehicle door as noted in the general part of the specification. During such a closing cycle the lock striker 4 comes into an actuating engagement with the motor vehicle lock 1 such that the catch 2 moves from its open position into the direction of its closed position, here and preferably into its closed position. This closed position may be the main closed position of the catch 2. However, it may also be the preliminary closed position of the catch 2, in which case a motorized closing aid may be provided that moves the catch 2 into its main closed position.

In most embodiments an actuating element 6 is provided, which is at least slightly displaceable relative to the catch 2. The actuating element 2 preferably is provided as an element separate from the catch 2. However, it may be advantageous that the actuating element 6 is connected to the catch 2, as long as it is at least slightly displaceable relative to the catch 2.

The actuating element 6 is coupled to the catch 2 such that during the closing cycle the actuating engagement of the lock striker 4 with the actuating element 6 causes the catch 2 to move from its open position (FIG. 1)) into its main closed position (FIG. 2*b*) for establishing the holding engagement between the catch 2 and the lock striker 4. As noted above, driving the catch 2 only into the direction of the closed position or into the preliminary closed position may be foreseen here as well.

It is particularly interesting that during a closing cycle the lock striker 4 comes into engagement with the actuating element 6, before it comes into holding engagement with the catch 2, which opens considerable room for designing the acoustic characteristic.

In all embodiments shown, during the closing cycle, the lock striker 4 travels on a closing path 7 relative to the motor vehicle lock 1, wherein the holding forces 5 acting between the catch 2 and the lock striker 4 during the holding engagement are aligned to the closing path 7.

The catch 2 comprises a holding engagement surface 8 for the holding engagement with the lock striker 4. Preferably, during movement of the catch 2 from the open position into the main closed position the holding engagement surface 8 travels basically in a direction perpendicular to the closing path 7, in the drawings from left to right.

FIGS. 1, 2*a* and 2*b* in combination show that the catch 2 during its movement from its open position into its closed position, with its holding engagement surface 8, crosses a crossing section 7*a* of the closing path 7. It may also be taken from this combination of figures that during the closing cycle the lock striker 4 passes the crossing section 7*a* of the closing path 7 before the catch 2 crosses the crossing section 7*a*. This synchronization is of particular importance for the function of the proposed motor vehicle lock.

During the holding engagement between the lock striker 4 and the catch 2 (FIGS. 2*a*, 2*b*) the lock striker 4 is in a holding position 9 for the main closed position (and in a holding position 9*a* for the preliminary closed position). It is preferred now that the actuating engagement between the lock striker 4 and the actuating element 6, when seen along the closing path 7, is taking place before the lock striker 4 reaching the holding position 9 (respective the holding position 9*a*). The first location of actuating engagement is denominated with the reference number 10 for clarification. With this sequence the above noted synchronization is possible with simple construction as will be explained in detail later.

The above noted kinematics allow the catch 2 to be of basically hook shaped design with a hook portion 11 connected to a shaft portion 11*a*, wherein the hook portion 11 provides the holding engagement surface 8 for the holding engagement between the catch 2 and the lock striker 4. Here and preferably the hook portion 11 is extending basically laterally with regard to the shaft portion 11*a*.

Depending on the application a pawl 12, that is pivotable around a pawl axis 12*a*, may be provided, that is assigned to the catch 2. The pawl 12 may be brought into a blocking position (FIGS. 2*a*, 2*b*), in which it is in blocking engagement with the catch 2. In the blocking position the pawl 12 prevents the catch 2 from pivoting from the respective closed position into the direction of the open position.

The pawl 12 may also be deflected into a release position (FIG. 1), in which it releases the catch 2. Here and preferably the catch 2 comprises a preliminary notch 13 and a main notch 14 for the blocking engagement between the pawl 12 and the catch 2. It is most preferred that the at least one notch 13,14 is/are arranged on an outer contour 15 of the catch 2, in particular on an outer contour of the hook portion 11.

In the shown embodiment at least the main notch 14 is arranged at an extension 11*b* of the hook portion 11. Here, the hook portion 11 and the extension 11*b* of the hook portion 11 extend from the shaft portion 11*a* into opposite directions.

In the preliminary closed position the striker 4 comes into engagement with a first holding engagement point 8*a*. In the main closed position, the striker 4 comes into engagement with a second holding engagement point 8*b*. Interesting is the fact that the second holding engagement point 8*b* is closer to the pivot axis 2*a* of the catch 2 than the first holding engagement point 8*b*. With this it is guaranteed that the two holding positions 9 (main closed position) and 9*a* (preliminary closed position) of the striker 4 are displaced to each other as needed.

It is apparent from the drawings that the distance between the preliminary notch 13, which is assigned to the preliminary closed position, and the main notch 14, which is assigned to the main closed position, is at least the distance between the above noted two holding engagement points 8*a*, 8*b*. This distance is fairly large, which may be advantageous as will be explained below.

During a closing cycle, first, the pawl 12 normally falls into engagement with the preliminary notch 13 and subsequently is being guided to a radially outer position, such that it can fall into engagement with the main notch 14. This guidance may be accomplished by the preliminary notch 13 itself, which is provided with a ramp 13*a* as shown in FIG. 1. In this case, the outer contour 15 between the preliminary notch 13 and the main notch 14 does not need to guide the pawl 12 anymore, such that it is mainly aligned to a circle around the pivot axis 2*a* of the catch 2.

In a an example embodiment not shown in the drawings the outer contour 15 between the preliminary notch 13 and the main notch 14 is a continuous connection between the ground of the preliminary notch 13 to the top of the main notch 14. This connection provides the function of the above noted ramp 13*a*. As it is stretched along the above noted, fairly large distance, the acceleration on the pawl 12 in the radial direction is low even with quick closing cycles which leads to a safe engagement of the pawl 12 with the main notch 14 and which also leads to low noise generation during the closing cycle.

All embodiments shown are provided with a special crash support arrangement 16 for those holding forces, that exceed a predetermined threshold and that lead to deformation of the motor vehicle lock. Those forces are assigned the direction of the holding forces 5 and act on the crash support arrangement 16 in particular when a deformation of the catch 2 or the pivot guide of the catch 2 has taken place. Such forces develop mainly in a crash situation, in particular because of crash accelerations.

The above noted crash forces here and desirably are supported by the crash support arrangement 16 via the outer contour 15 of the catch 2. Preferably this is the same outer contour 15 which comprises the above noted, at least one notch 13, 14.

The crash support arrangement 16 comprises at least one support element 17, 18. In order to achieve a symmetric support in view of the holding forces 5 it is further preferred that at least two crash support elements 17, 18 are arranged oppositely to each other with respect to the inlet mouth 3 for the lock striker 4.

In the embodiments shown, in order to achieve a compact design, the pawl 12 itself provides a crash support element 17. The other, in the above noted sense oppositely to the pawl 12 arranged crash support element 18 is designed as a simple bolt.

The embodiments shown in FIGS. 1, 2 and FIGS. 3, 4 are based on a special spring bias of the catch 2. First of all it is important that in its open position the catch 2 is spring biased into its open position by an opening spring arrangement 19.

Further it is important that in its open position the catch 2 is also spring biased into its closed position by a closing spring arrangement 20. Accordingly the two spring arrangements 19, 20 are working against each other.

Here and preferably, in the open position of the catch 2, the spring bias into the open position overrules the spring bias into the closed position. With this it is guaranteed that in the open position of the catch 2, without any interaction with the lock striker 4, the catch 2 stays in the open position due to its resulting spring bias.

Figure 2:
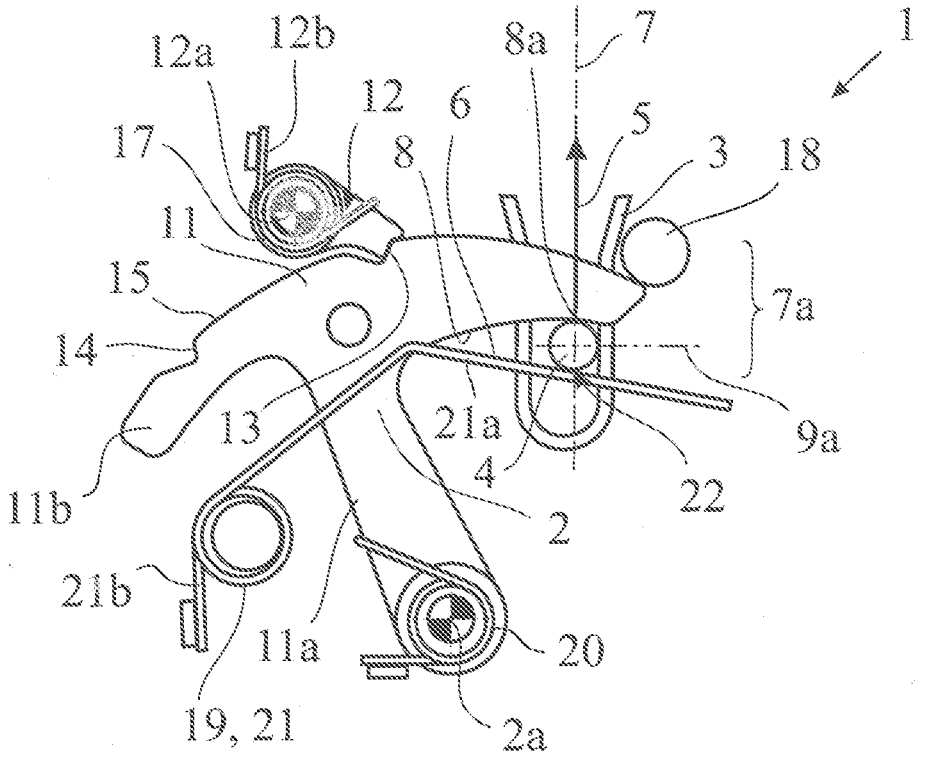
Figure 2:
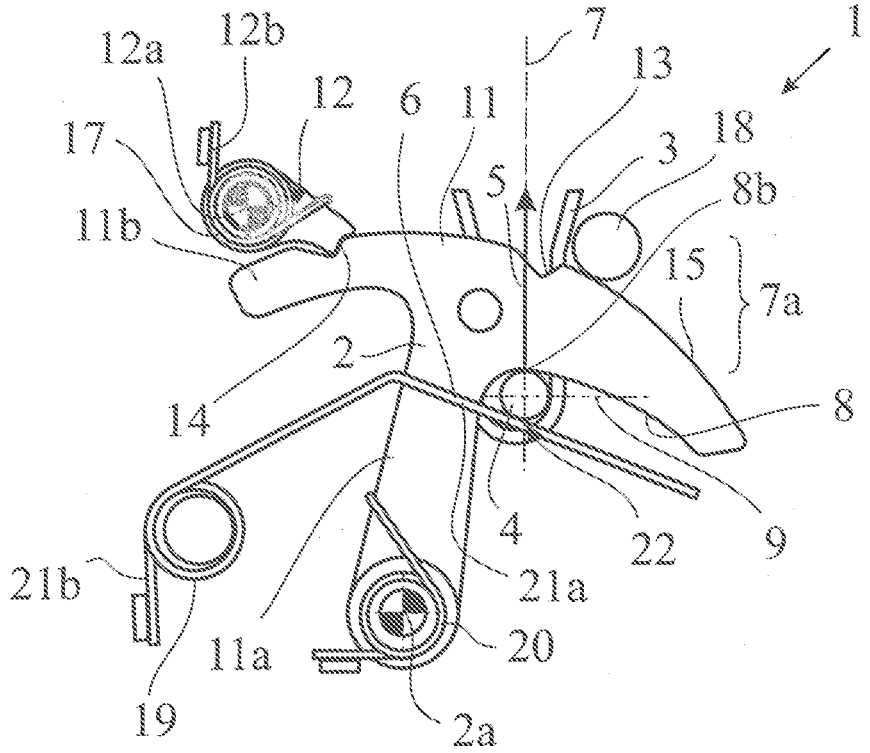

In the preferred embodiment according to FIGS. 1, 2 the actuating element 6 is part of the opening spring arrangement 19 such that the actuating engagement between the lock striker 4 and the actuating element 6 causes the closing spring arrangement 20 to overrule the opening spring arrangement 19. As a result the catch 2 moves from its open position to the closed position which may be taken from the combination of FIGS. 1, 2*a*, 2*b*.

Figure 3:
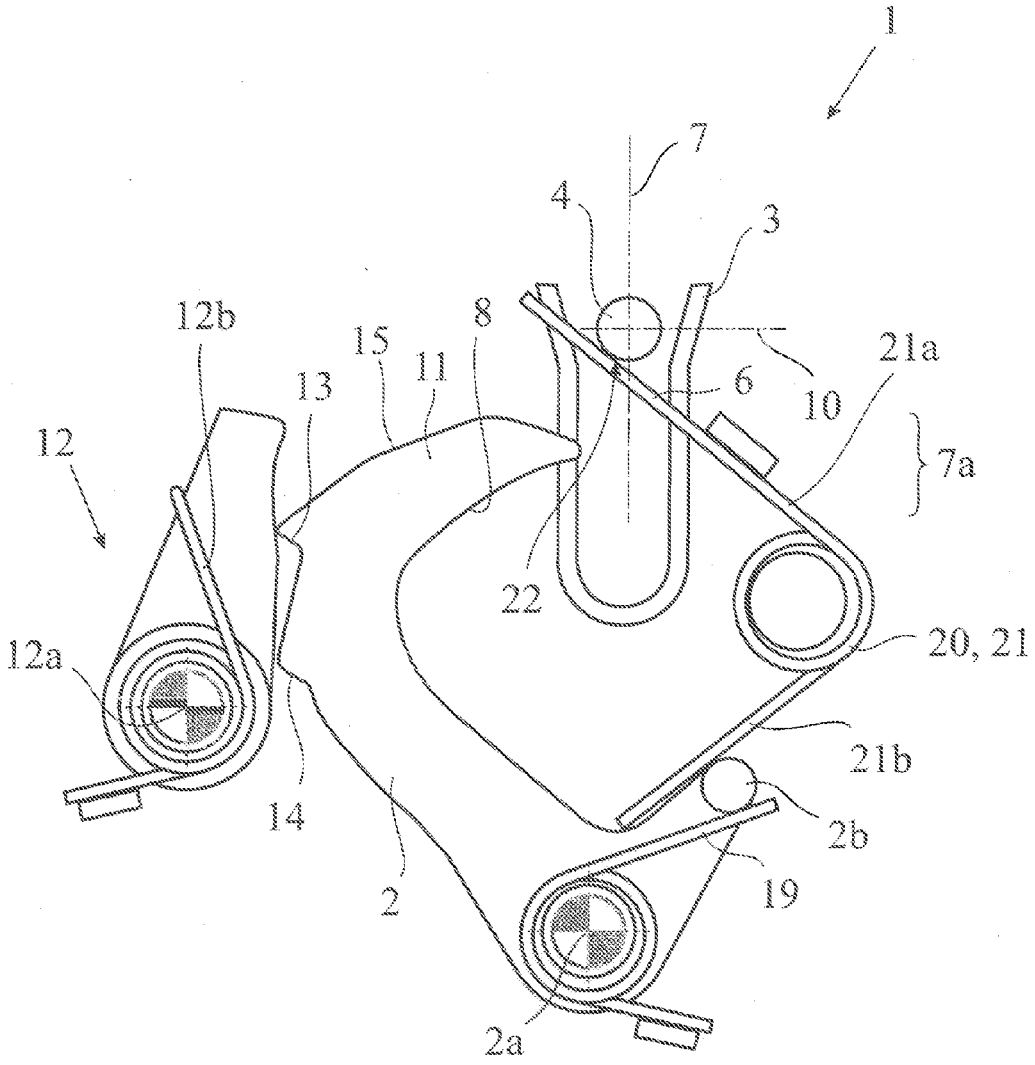
Figure 4:
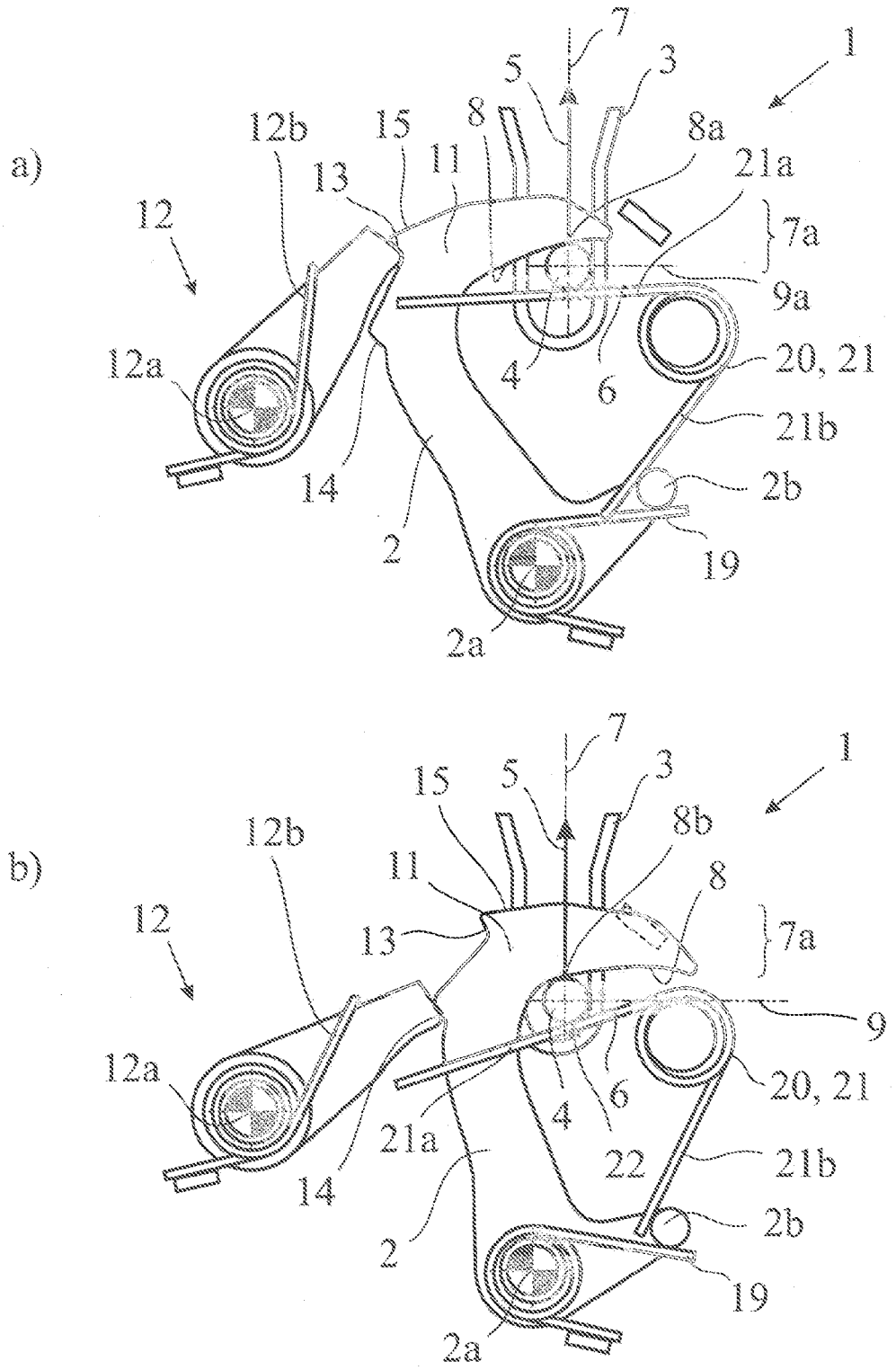

As an alternative, FIGS. 3, 4*a* and 4*b* show that the actuating element 6 is part of the closing spring arrangement 20, such that the actuating engagement between the lock striker 4 and the actuating element causes the closing spring arrangement 20 to overrule the opening spring arrangement 19 such that again the catch 2 moves from its open position to the closed position.

In both alternatives the actuating element 6 may as well be coupled to the opening spring arrangement 19 or the closing spring arrangement 20 instead of being part of the respective spring arrangement 19, 20.

In both embodiments shown in FIGS. 1, 2*a*, 2*b* and FIGS. 3, 4*a*, 4*b* the actuating element 6 comprises, preferably is, a leg spring 21. The leg spring 21 comprises two legs 21*a*, 21*b*, one of which provides an engagement section 22 for the actuating engagement with the lock striker 4 and the other of which is preferably fixed. With the catch 2 in its open position the leg 21*a*, which comprises the engagement section 22, crosses the inlet mouth 3. This guarantees that during the closing cycle the lock striker 4 comes into actuating engagement with the actuating element 6 as noted above. For this effect it can also be sufficient that the leg 21*a*, which comprises the engagement section 22, extends somewhat into the inlet mouth 3.

In the preferred embodiment shown in FIGS. 1 and 2 the same leg 21*a*, which comprises the engagement section 22, is in engagement with the catch 2, in particular with a bolt 2*b* connected to the catch 2. In the further preferred embodiment shown in FIGS. 3 and 4, the leg 21*b*, which does not comprise the engagement section 22, is in engagement with the catch 2, in particular with a bolt 2*b* connected to the catch 2.

It is particularly interesting that in the embodiments shown in FIGS. 1, 2*a*, 2*b* and FIGS. 3, 4*a*, 4*b* during a closing cycle the lock striker 4 interacts with the actuating element 6 before the holding engagement between the catch 2 and the lock striker 4 is established. It is apparent from the drawings that an actuating engagement between a lock striker 4 and a leg spring 21 being part of the opening spring arrangement 19 or the closing spring arrangement 20 cannot lead to high impact noises. Therefore the proposed solution provides an improved acoustic characteristic with low constructional effort.

Finally it may be pointed out that due to using a hook shaped catch the resulting forces on the pawl 12 in its blocking position are comparably low. Actuation of the pawl 12, be it manually or motor driven, requires only low actuation forces.

We claim:

1. A motor vehicle lock for a motor vehicle door arrangement, comprising:

a pivotable catchy;

an inlet mouth for a lock striker; and an actuating element;

wherein the catch can be brought into at least one closed position and into at least one open position, wherein the catch in the closed position is configured to hold the lock striker by a holding engagement between the catch and the lock striker and in the open position is configured to release the lock striker;

wherein during a closing cycle the lock striker comes into an actuating engagement with the motor vehicle lock such that the catch moves from the open position in the direction of the closed position;

wherein the actuating element is displaceable relative to the catch and the actuating element is coupled to the catch such that during the closing cycle the actuating engagement of the lock striker with the actuating element causes the catch to move from the open position in the direction of the closed position for establishing the holding engagement between the catch and the lock striker; and wherein the actuating element is part of or coupled to an opening spring arrangement and/or a closing spring arrangement such that the actuating engagement between the lock striker and the actuating element causes the closing spring arrangement to overrule the opening spring arrangement such that the catch moves from the open position to the closed position.

2. A motor vehicle lock according to claim 1, wherein during a closing cycle the lock striker comes into engagement with the actuating element, before it comes into engagement with the catch.

3. A motor vehicle lock according to claim 1, wherein during the closing cycle the lock striker travels on a closing path relative to the motor vehicle lock and that the holding forces acting between the catch and the lock striker during the holding engagement are aligned mainly to the closing path.

4. A motor vehicle lock according to claim 1, wherein the catch comprises a holding engagement surface for the holding engagement with the lock striker.

5. A motor vehicle lock according to claim 1, wherein the catch during its movement from the open position into the closed position crosses a crossing section of the closing path.

6. A motor vehicle lock according to claim 1, wherein during the holding engagement between the lock striker and the catch, the lock striker is in a holding position and wherein the actuating engagement between the lock striker and the actuating element, when seen along the closing path, takes place before the lock striker reaching the holding position.

7. A motor vehicle lock according to claim 1, wherein the catch has a hook shaped design with a hook portion connected to a shaft portion and wherein the hook portion provides the holding engagement surface for the holding engagement between the catch and the lock striker.

8. A motor vehicle lock according to claim 1, wherein a pivotable pawl is assigned to the catch, wherein the pawl may be brought into a blocking position, in which it is in blocking engagement with the catch in the closed position and wherein the pawl may be deflected into a release position, in which it releases the catch.

9. A motor vehicle lock according to claim 8, wherein at least one notch is arranged on an outer contour of the catch and wherein the outer contour is arranged at the hook portion and/or at an extension of the hook portion.

10. A motor vehicle lock according to claim 1, wherein the catch can be brought into a preliminary closed position, in which the striker comes into engagement with a first holding engagement point and into a main closed position, in which the striker comes into engagement with a second holding engagement point, wherein the second holding engagement point is closer to the pivot axis of the catch than the first holding engagement point.

11. A motor vehicle lock according to claim 10, wherein the distance between a preliminary notch, which is assigned to the preliminary closed position, and the main notch, which is assigned to the main closed position, is at least the distance between the two holding engagement points.

12. A motor vehicle lock according to claim 11, wherein the outer contour between the preliminary notch and the main notch is a continuous connection between the ground of the preliminary notch to the top of the main notch, or, wherein the outer contour between the preliminary notch and the main notch is mainly aligned to a circle around the pivot axis of the catch.

13. A motor vehicle lock according to claim 1, further comprising a crash support arrangement, the crash support arrangement comprising at least two crash support elements, wherein the at least two crash support elements are arranged oppositely to each other with respect to the inlet mouth, and wherein holding forces, that exceed a predetermined threshold and that lead to deformation of the motor vehicle lock, are supported by the crash support arrangement.

14. A motor vehicle lock according to claim 1, wherein in its open position the catch is spring biased into its open position by an opening spring arrangement.

15. A motor vehicle lock according to claim 1, wherein at least in its open position the catch is spring biased into its closed position by a closing spring arrangement.

16. A motor vehicle lock according to claim 1, wherein in the open position of the catch a spring bias into the open position overrules a spring bias into the closed position.

17. A motor vehicle lock according to claim 1, wherein the actuating element comprises a leg spring with two legs, one of which legs provides an engagement section for the actuating engagement with the lock striker.

18. A motor vehicle lock according to claim 1, wherein when the catch is in the open position, the actuating element extends into the inlet mouth.

* * * * *